US005758677A

United States Patent [19]

Wang

[11] Patent Number: 5,758,677

[45] Date of Patent: Jun. 2, 1998

[54] UMBRELLA STRUCTURE FOR CONTROLLING AN AUTOMATIC OPENING

[76] Inventor: Shen Ho Wang, No. 51, Sec. 3, Ten Chin Road, Taichung, Taiwan

[21] Appl. No.: 869,175

[22] Filed: Jun. 5, 1997

[51] Int. Cl.[6] ..... A45B 25/14

[52] U.S. Cl. ..... 135/24; 135/20.3; 135/22

[58] Field of Search ..... 135/22, 24, 15.1, 135/20.3, 28, 37, 38, 39

[56] References Cited

U.S. PATENT DOCUMENTS

| | | | |
|---|---|---|---|
| 4,807,655 | 2/1989 | Robertson | 135/22 |
| 4,941,494 | 7/1990 | Wu | 135/22 X |
| 4,989,625 | 2/1991 | Wu | 135/22 |
| 5,174,319 | 12/1992 | Chou et al. | 135/24 X |
| 5,178,174 | 1/1993 | Wu | 135/24 X |
| 5,390,686 | 2/1995 | Lin et al. | 135/24 |
| 5,505,222 | 4/1996 | Lin et al. | 135/24 |
| 5,617,889 | 4/1997 | Wu | 135/24 X |
| 5,626,160 | 5/1997 | Ko | 135/22 |
| 5,645,094 | 7/1997 | Wu | 135/24 |

*Primary Examiner*—Lanna Mai

*Attorney, Agent, or Firm*—Morton J. Rosenberg; David I. Klein; Jun Y. Lee

[57] ABSTRACT

The present invention relates to an improved umbrella including a spring received in a shaft of the umbrella and a controlling piece mounted on the shaft for engaging with a runner in closing state. By use of a slidable piece provided within the shaft and a connecting wire, it is capable of being automatic opened. Because of the spring is received in the shaft and prevented from being rusted or damaged, the invented structure of the umbrella is useful and has improvements.

1 Claim, 2 Drawing Sheets

UMBRELLA STRUCTURE FOR CONTROLLING AN AUTOMATIC OPENING

BACKGROUND OF THE INVENTION

A prior known auto-opening unfolded umbrella is provided with a spring around the shaft which is connected to a runner of the umbrella. The lower end of the spring is provided with a hook to connect within the upper portion of the runner which is thus somehow large. That is the reason why the known unfolded umbrella always can not be reduced its size effectively. Moreover, the spring and the hook are usually made of ironic piece. It is easily be rusted and damaged because of being exposed to air or rain all the time.

The main objective of the present invention is to provide an improved umbrella with an invented structure of elastic spring received in the shaft and overcomes the drawback of a prior one.

BRIEF DESCRIPTION ACCOMPANYING DRAWINGS

Now the structure and features of the invention will be described below in detailed with reference to the accompanying drawings in which.

DETAILED DESCRIPTION OF A PREFERRED EMBODIMENT

Figure 1:
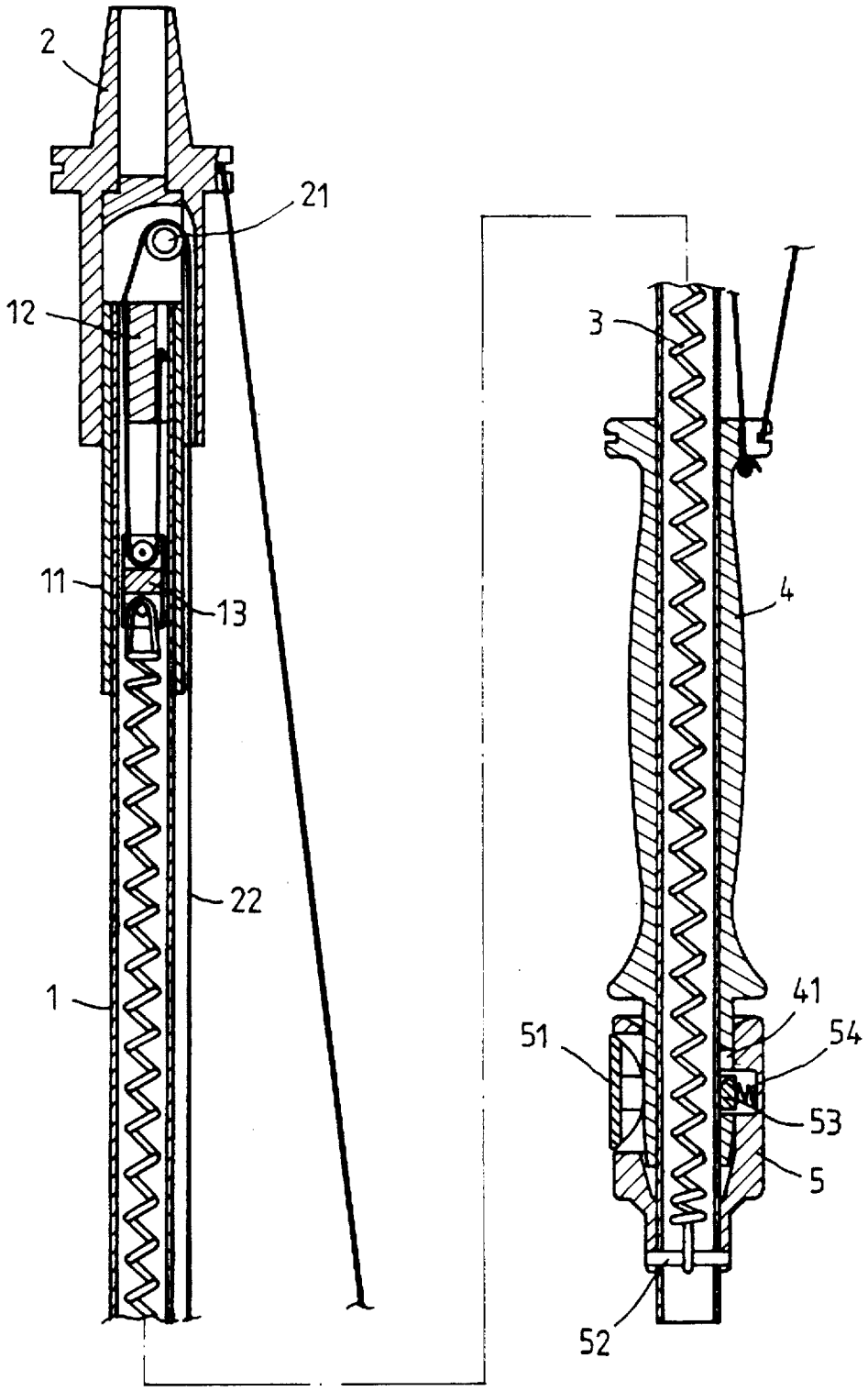
FIG. 1 is a partly cross sectional view of an umbrella according to the present invention in closing state.
Figure 2:
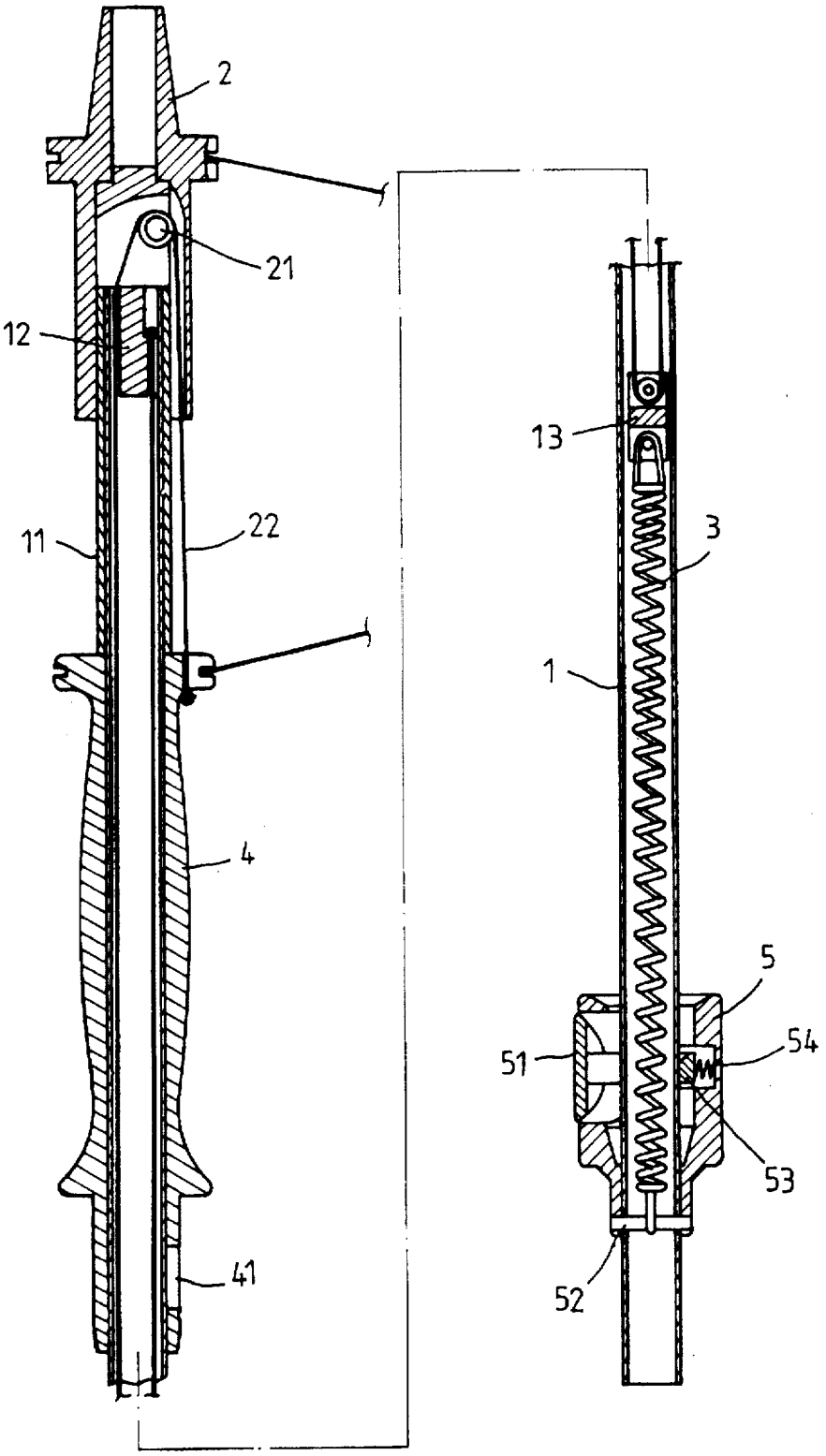
FIG. 2 is a cross sectional view of FIG. 1 in opening state according to this invention.

Now referring to the FIGS. 1 and 2, it can be seen that an unfolded umbrella according to the present invention includes a shaft 1, a top connector 2, a spring 3, a runner 4, and a controlling piece 5; wherein a sleeve 11 is mounted around the top portion of the shaft 1 and is then connected within the top connector 2. A fixed piece 12 is provided within the shaft 1 at the top portion and a slidable piece 13 is provided with the shaft 1 below the fixed piece 12. The controlling piece 5 is connected on the lower portion of the shaft 1 by a pin 52. The spring 3 has its upper end connected with the slidable piece 13 and its lower end with the pin 52. The runner 4 is provided around the shaft 1 slidably between the sleeve 11 and the controlling piece 5. A connecting wire 22 has its one end connected on the runner 4, and the other end passes through top connector 2 rounding an inner axis 21, penetrating the fixed piece 12, extending to another axis of the slidable piece 13, and then upward extending to connect with the fixed piece 12.

In FIG. 1, it shows the umbrella in closing state. The lower end of the runner 4 is inserted into the controlling piece 5, while a groove 41 of the runner 4 is engaged by a projection 53 of the controlling piece 5. At this time, the spring 3 is extended since the slidable piece is moved upward by the connecting wire 22. When a user pushes a button 51 forcing the projection 53 moving back to a spring 54 there behind, the runner 4 cab be released and under recovery force of the spring 3, the slidable piece 13 is moved downward which pulls the connecting wire 22 to pull runner 4 upward and to open the umbrella as an automatic opening, shown in FIG. 2.

From above mentioned structure, the present invention provides the inner spring accompanying with the connecting wire for an automatic opening of the umbrella. Meanwhile, the inner spring 3 is received in the shaft 1 and will not be rusted or damaged as a prior one, and the runner 3 is capable of having a smaller size than a known one for carrying in convenience.

Although this invention has been described in connection with specific forms and embodiments thereof, it is to be understood that all matter herein described or shown in the accompanying drawings is to be interpreted as illustrative and not in a limiting sense. Thus it will be appreciated that the drawings are exemplary of a preferred embodiment of the invention. Various modifications may be made without departing from the scope of the appended claims.

I claim:

1. An improved umbrella structure including a shaft connected with an upper top connector and a lower controlling piece, and a runner being rounding the shaft and a spring being received in the shaft of the umbrella;

wherein a sleeve mounted around the top portion of the shaft and connected within the top connector; a fixed piece provided within the shaft and a slidable piece provided within the shaft below the fixed piece; and the controlling piece connected on the lower portion of the shaft by a pin; the spring having its upper end connected with the slidable piece and its lower end with the pin; the runner provided around the shaft slidably between the sleeve and the controlling piece; a connecting wire having its one end connected on the runner, and the other end passes through top connector rounding an inner axis, penetrating the fixed piece, extending to another axis of the slidable piece, and then upward extending to connect with the fixed piece.

* * * * *